US008464946B2

(12) United States Patent
Mackenzie et al.

(10) Patent No.: US 8,464,946 B2
(45) Date of Patent: Jun. 18, 2013

(54) OIL AND GAS RISER SPIDER WITH LOW FREQUENCY ANTENNA APPARATUS AND METHOD

(75) Inventors: Patricia Mackenzie, Clifton Park, NY (US); Judith Ann Guzzo, Niskayuna, NY (US); Lynn Ann DeRose, Gloversville, NY (US); Brandon Stephen Good, Schenectady, NY (US)

(73) Assignee: Vetco Gray Inc., Houston, TX (US)

( * ) Notice: Subject to any disclaimer, the term of this patent is extended or adjusted under 35 U.S.C. 154(b) by 252 days.

(21) Appl. No.: 12/710,707

(22) Filed: Feb. 23, 2010

(65) Prior Publication Data

US 2011/0204143 A1 Aug. 25, 2011

(51) Int. Cl.
*G06F 19/00* (2011.01)

(52) U.S. Cl.
USPC ..... 235/385; 235/375; 235/376; 705/28; 340/853.1; 166/250.01

(58) Field of Classification Search
USPC ..... 235/375, 376, 383, 385; 209/365.1, 209/412, 552; 166/64, 65.1, 250.01, 255.1, 166/350, 367, 381; 73/86, 152.28, 152.54, 73/152.57; 340/10.1, 572.1, 572.4, 572.8, 340/853.1; 705/28
See application file for complete search history.

(56) References Cited

U.S. PATENT DOCUMENTS

| | | | | |
|---|---|---|---|---|
| 2,282,758 | A | 5/1942 | Gallagher | |
| 3,981,369 | A | 9/1976 | Bokenkamp | |
| 5,142,128 | A | 8/1992 | Perkin et al. | |
| 5,202,680 | A * | 4/1993 | Savage | 340/853.1 |
| 5,360,967 | A | 11/1994 | Perkin et al. | |
| 6,227,587 | B1 | 5/2001 | Terral | |
| 6,347,292 | B1 | 2/2002 | Denny et al. | |
| 6,401,825 | B1 | 6/2002 | Woodrow | |
| 6,480,811 | B2 | 11/2002 | Denny et al. | |
| 6,604,063 | B2 | 8/2003 | Denny et al. | |
| 6,973,416 | B2 | 12/2005 | Denny et al. | |
| 7,062,413 | B2 | 6/2006 | Denny et al. | |
| 7,159,654 | B2 * | 1/2007 | Ellison et al. | 166/250.01 |
| 7,328,741 | B2 | 2/2008 | Allen et al. | |
| 7,389,205 | B2 | 6/2008 | Denny et al. | |

(Continued)

FOREIGN PATENT DOCUMENTS

WO 2006/041306 A1 4/2006

OTHER PUBLICATIONS

Industrial RFID—Merrick Systems http://www.merricksystems.com/products/industrial.

*Primary Examiner* — Michael G Lee
*Assistant Examiner* — Tabitha Chedekel
(74) *Attorney, Agent, or Firm* — Bracewell & Giuliani LLP

(57) ABSTRACT

An apparatus and methods for tracking a plurality of marine riser assets is provided. Part of a riser lifecycle monitoring system, the apparatus can include an oil and gas riser spider to connect a plurality of riser pipe sections during assembly of a riser pipe string. The riser spider forms an annulus around a first section of the plurality of riser pipe sections and supports the first section of the plurality of riser pipe sections during connection to a second section. The apparatus can also include an antenna to read a plurality of radio frequency identification tags, e.g., directional 125 kHz RFID tags, attached to outsides of the plurality of riser pipe sections. The antenna can include an oblong loop attached to and substantially spanning about half of an internal surface of the riser spider so that the antenna follows the contour of the riser spider.

20 Claims, 6 Drawing Sheets

U.S. PATENT DOCUMENTS

2008/0128138 A1 6/2008 Radi
2008/0136733 A1 6/2008 DeRose et al.
2008/0165011 A1 7/2008 Staff
2010/0213942 A1* 8/2010 Lazarev ..... 324/333

* cited by examiner

OIL AND GAS RISER SPIDER WITH LOW FREQUENCY ANTENNA APPARATUS AND METHOD

BACKGROUND OF THE INVENTION

1. Field of the Invention

The present invention relates to the oil and gas industry. More particularly, the present invention relates to an oil and gas spider apparatus with a built-in antenna and related methods for use in a riser management system that monitors and manages a plurality of marine riser assets.

2. Description of Related Art

In the oil and gas industry, a riser is a string of pipe between the sea bottom and ship or rig. Oil and gas riser pipe strings are assembled using a device known as a "spider." The spider feeds and connects each section of riser pipe in the string. Spiders can have different configurations. Some spiders are made of a solid ring that the riser feeds through; some spiders are made of two pieces that close around a riser pipe and then feed the riser pipe through. For each configuration type of spider, the riser pipes are all fed into the spider in the same orientation.

During a typical field installation at sea, marine riser components are individually lifted from the deck of a vessel, connected to each other at the riser spider, and run down. Riser joints, which comprise the major length of the riser string, are fabricated in lengths ranging from 50' to 90'. During the running procedure, the portion of the riser string that is fully made up is landed on the riser spider. The next riser joint is then picked up and placed just over the spider, immediately above the suspended riser string. The two riser sections are then joined by means of a mechanical connector.

Riser Lifecycle Management Systems (RLMS) have been described, such as in co-owned United States Patent Publication Number US 2008/0128138 A1, which is herein incorporated by reference in its entirety. Such riser lifecycle management systems, for example, can provide asset managers a list of all the riser assets allocated to specific vessels and provide a further breakdown of those assets that are currently deployed, are on deck, or are out for maintenance, along with the expected return date; a list of upcoming scheduled maintenance events; an estimate of the amount of operational life being expanded by a particular riser asset; and an estimate of the total amount of operational life used by a particular riser asset, along with the details of the most damaging events (i.e., a certain hurricane event). Such riser lifecycle management systems can include, for example, a central database that can be used by field and maintenance personnel to maintain and communicate critical riser information, and that can enhance both routine maintenance scheduling and identifying a need for an unscheduled maintenance event.

Today, known stationary readers associated with a riser spider can interfere with normal operation of the spider. For example, known designs can require contact of an antenna and tag.

Today, directional 125 kHz RFID tags are being embedded in drill pipes and read using a handheld reader in a manual process. Drill pipes have a smaller diameter than riser pipes.

SUMMARY OF THE INVENTION

In view of the foregoing, Applicants recognize that a manual process for reading riser pipes is error-prone and expensive. Moreover, Applicants recognize the need for apparatuses and related methods for automatically reading riser pipes, without requiring hand-held readers, manual processes, or interference with normal operations. Specifically, Applicants recognize that a low frequency (LF), stationary reader antenna built into a spider would allow riser pipes to be read automatically, as the pipes are loaded. Moreover, Applicants recognize the advantages of an antenna for various spider designs, including both ring and two-piece spiders. Accordingly, embodiments of the present invention advantageously provide an oil and gas spider apparatus with a built-in antenna and related methods. Embodiments can, for example, enhance a riser management system that monitors and manages a plurality of riser assets, e.g., marine riser assets.

Embodiments of the present invention include, for example, an apparatus. The apparatus can include a riser spider to connect a plurality of riser pipe sections during assembly of a riser pipe string. The riser spider can be positioned to form an annulus around a first section of the plurality of riser pipe sections and to support the first section of the plurality of riser pipe sections during connection to a second section of the plurality of riser pipe sections. The apparatus can include an antenna to read a plurality of radio frequency identification tags attached to outsides of the plurality of riser pipe sections, the antenna including an oblong loop attached to and substantially spanning about half of an internal surface of the riser spider so that the antenna follows the contour of the riser spider.

Embodiments of the present invention can include, for example, a method of tracking marine riser pipe sections. The method can include, for example, providing a plurality of radio frequency identification tags attached to outsides of and associated with a plurality of riser pipe sections. The method can include, for example, utilizing a riser spider to connect the plurality of riser pipe sections during assembly of a riser pipe string. The riser spider can form an annulus around a first section of the plurality of riser pipe sections and support the first section of the plurality of riser pipe sections during connection to a second section of the plurality of riser pipe sections. The method can include, for example, reading each of the plurality of radio frequency identification tags during a feeding of the associated riser pipe section through the riser spider utilizing an antenna. The antenna can include an oblong loop attached to and substantially spanning about half of an internal surface of the riser spider so that the antenna follows the contour of the riser spider.

Embodiments of the present invention can further include, for example, a method of tracking a plurality of riser pipe sections. The method can include, for example, for each of a plurality of riser pipe sections, receiving riser pipe section identification data from a radio frequency identification tag attached to an outside of and associated with a riser pipe section utilizing an antenna during a feeding of the riser pipe section through a riser spider during assembly of a riser pipe string to separately identify each one of the plurality of riser pipe sections from each other of the plurality of riser pipe sections. The antenna can include an oblong loop attached to and substantially spanning about half of an internal surface of the riser spider so that the antenna follows the contour of the riser spider. The method can include, for example, determining a relative deployed position location of the each of the plurality of riser pipe sections to form the riser pipe string.

Other prior solutions require hand-held or stationary readers, and necessarily alter or interfere with normal operation of the riser pipe string. In addition, embodiments of the present invention advantageously provide a solution for various riser spider configurations, including spiders that are made of two pieces that close around a riser pipe.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

Applicants recognize that a manual process for reading riser pipes is error-prone and expensive. Moreover, Applicants recognize the need for apparatuses and related methods for automatically reading riser pipes, without requiring handheld readers, manual processes, or interference with normal operations. Specifically, Applicants recognize that a low frequency (LF), stationary reader antenna built into a riser spider would allow riser pipes to be read automatically, as the pipes are fed through the riser spider. Moreover, Applicants recognize the advantages of an antenna for various spider designs, including both ring and two-piece spiders. Accordingly, embodiments of the present invention advantageously provide an oil and gas spider apparatus with a built-in antenna and related methods. Embodiments can, for example, enhance a riser management system that monitors and manages a plurality of riser assets, e.g., marine riser assets.

Figure 1:
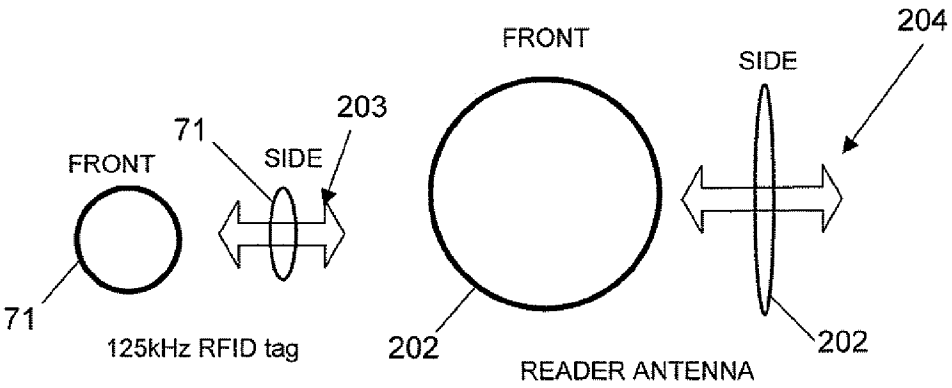
FIG. 1 are schematic views of the directional fields of an 125 kHz RFID tag and a reader antenna according to an embodiment of the present invention.
Figure 3:
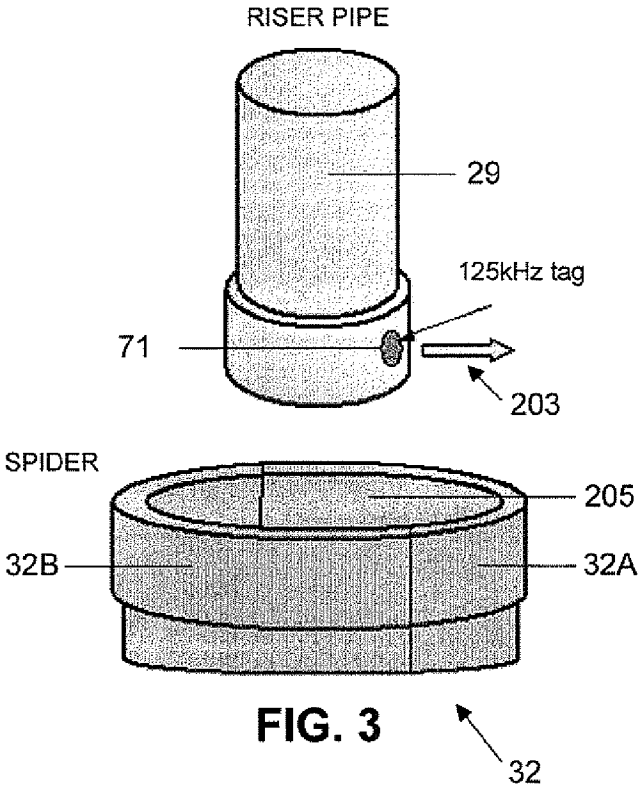
FIG. 3 is a schematic view a riser and spider setup according to an embodiment of the present invention.

Embodiments of the present invention include, for example, RFID tags, e.g., 125 kHz RFID tags. As illustrated in FIG. 1, 125 kHz RFID tags 71 can be directional and can only be read on one side, defining a read field 203. As further illustrated in FIG. 1, a reader antenna 202 must be facing the 125 kHz RFID tags 71 so that its read field 204 is directed toward the antenna 202. Accordingly, embodiments include directional RFID tag 71, as illustrated in FIG. 3, being positioned on a riser pipe 29 so that the tag's read field 203 is directed outward. Applicants recognize that otherwise the read field 203 will be directed inward toward the pipe 29 and away from any reader, including, for example, an antenna embodiment built into a spider. A spider 32, which feeds and connects each section of riser pipe in the string, surrounds or envelopes each riser pipe as it is added to the string so that an internal surface 205 of the spider 32 faces the a directional RFID tag 71 positioned on a riser pipe 29 and directed outward. As further illustrated in FIG. 3, some spiders 32 are made of two pieces 32A, 32B that close around a riser pipe 29 and then feeds the riser pipe through.

Figure 2:
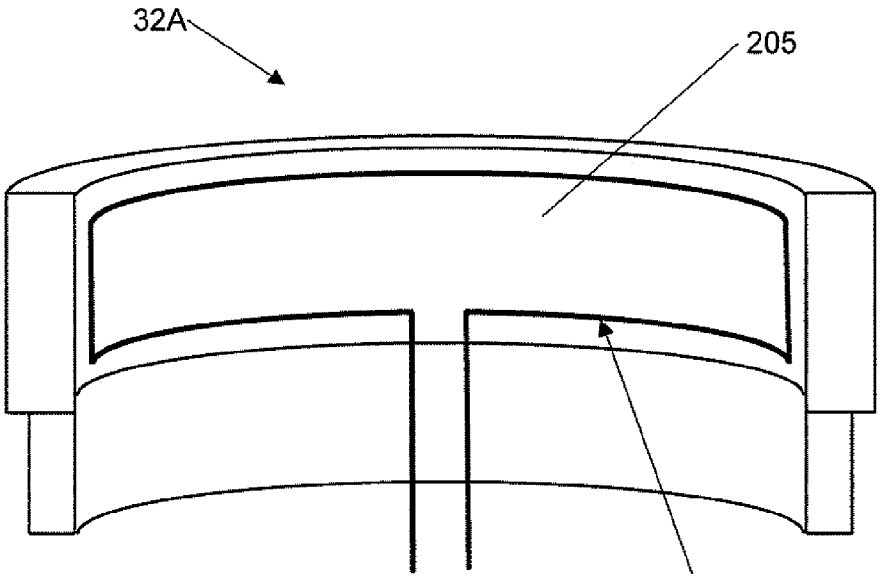
FIG. 2 is a schematic view of antenna placement according to an embodiment of the present invention.

As illustrated in FIG. 2, embodiments of the present invention can include, for example, placement of an antenna 201 on an internal surface 205 of a spider 32, or a portion of spider 32A. An antenna 201 embodiment can include, for example, an oblong loop that follows the contour of the spider 32, or a portion of spider 32A, for example, an oblong loop attached to and substantially spanning about half of an internal surface 205 of a riser spider 32, or about 180 degrees of the ring defined by the spider. As illustrated in FIG. 2, one piece 32A of a two-piece spider 32 can include an antenna 201 embodiment having an oblong loop that follows the contour of the riser spider to thereby provide maximum readability.

Figure 9:
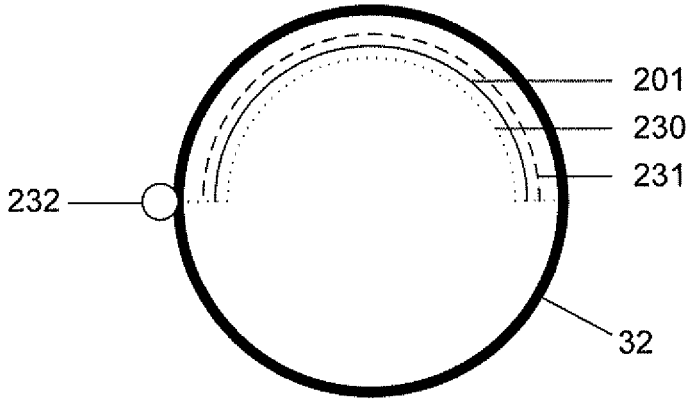
FIG. 9 is top view of a schematic block diagram of an apparatus according to an embodiment of the present invention.

Embodiments of the present invention include, for example, an apparatus. The apparatus can include, for example, a riser spider 32 to connect a plurality of riser pipe sections 29 during assembly of a riser pipe string. The riser spider 32 can form an annulus around a first section of the plurality of riser pipe sections and support the first section of the plurality of riser pipe sections during connection to a second section of the plurality of riser pipe sections. The apparatus can include, for example, an antenna 201 to read a plurality of radio frequency identification tags 71 attached to outsides of the plurality of riser pipe sections 29. The antenna can include an oblong loop attached to and substantially spanning about half of an internal surface of the riser spider so that the antenna follows the contour of the riser spider. The apparatus can also include an adhesive 231 (see, e.g., FIG. 9) to attach the antenna to the internal surface of the spider and a protectant 230 (see, e.g., FIG. 9) to protect the antenna from an ocean environment. The protectant 230 can seal the antenna to the spider. An exemplary embodiment can include use of commercially available polyetheretherketone (PEEK) or marginalized epoxy resin for subsea applications. In other embodiments, attachment of the antenna to the spider can be through clamps, wiring, and other approaches as understood by those skilled in the art. The apparatus can also include a low-frequency, substantially stationary, passive reader 73 of radio frequency identification tags. (See, e.g., FIG. 7B.) The reader 73 can be operably connected to the antenna.

In an example embodiment of an apparatus, the riser spider can include two portions 32A, 32B that together close around the first section of the plurality of riser pipe sections 29 to form the annulus, with each portion comprising a semi-circumference of the annulus. The riser spider 32 can also include the two portions being connected by a hinge 232 (see, e.g., FIG. 9).

Placement of the antenna 201 on the internal surface 205 of the spider 32 allows the tag 71 on the riser pipe 29 to be read as it moves through the spider, automatically and without manually bringing a reader to the riser pipe 29 or the riser pipe 29 to a reader. In addition, because no direct contact between the riser pipe 29 and the antenna 201 for the reader is necessary, embodiments of the present invention do not interfere with normal operation of the riser pipe string.

Other prior solutions require hand-held or stationary readers, and necessarily alter or interfere with normal operation of the riser pipe string. In addition, embodiments of the present invention advantageously provide a solution for various riser spider configurations, including spiders that are made of two pieces that close around a riser pipe.

Figures 4, 5:
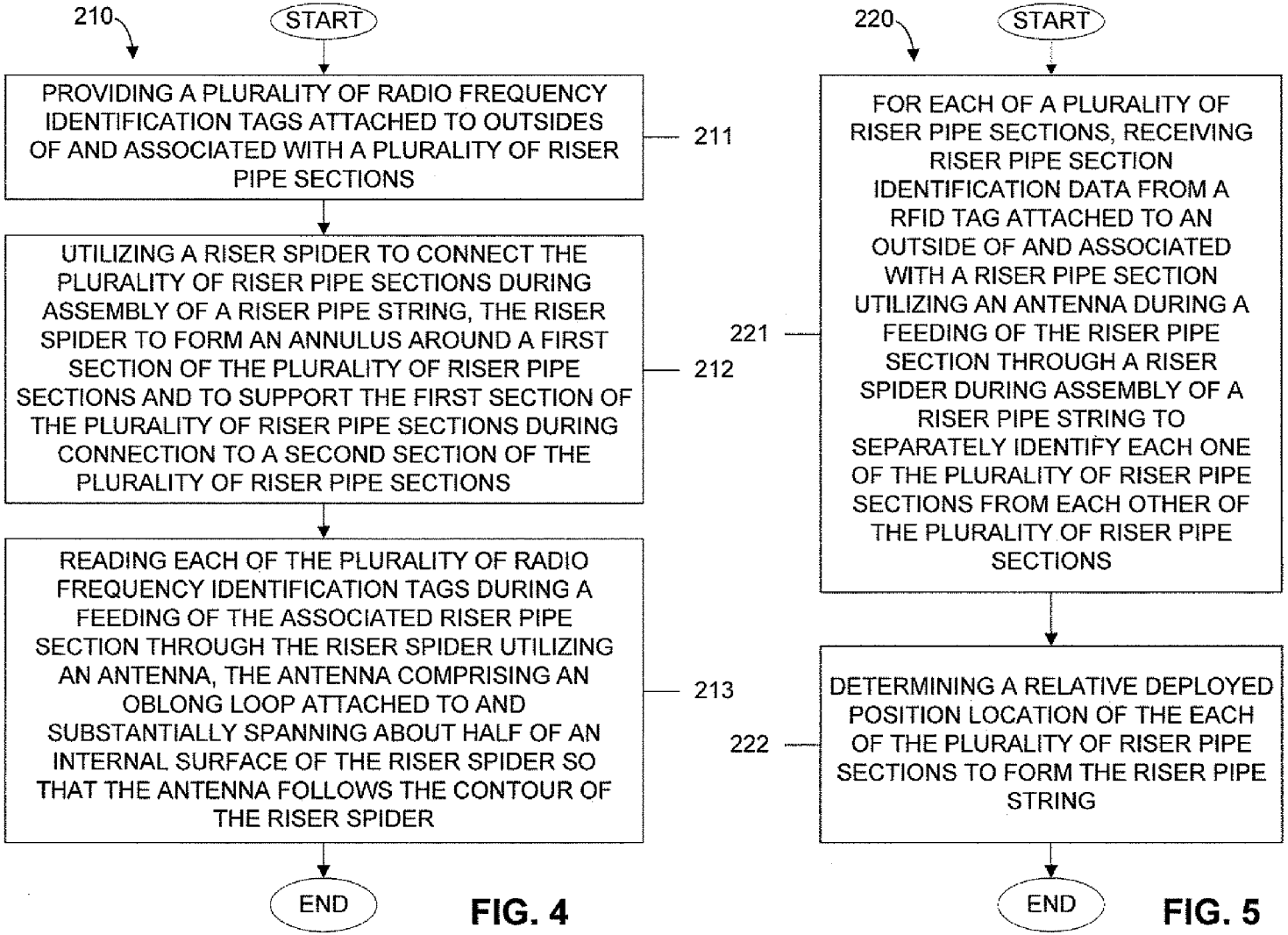
FIG. 4 is a schematic block diagram of method of tracking marine riser pipe sections according to an embodiment of the present invention.
FIG. 5 is a schematic block diagram of method of tracking a plurality of marine riser pipe sections according to an embodiment of the present invention.

As illustrated in FIG. 4, embodiments of the present invention include, for example, a method 210 of tracking marine riser pipe sections 29. The method 210 can include, for example, providing a plurality of radio frequency identification tags 71 attached to outsides of and associated with a plurality of riser pipe sections (211). The method 210 can include, for example, utilizing a riser spider 32 to connect the plurality of riser pipe sections 29 during assembly of a riser pipe string (212). The riser spider can form an annulus around a first section of the plurality of riser pipe sections and support the first section of the plurality of riser pipe sections during connection to a second section of the plurality of riser pipe sections. The method 210 can include, for example, reading each of the plurality of radio frequency identification tags 71 during a feeding of the associated riser pipe section through the riser spider 32 utilizing an antenna (213). The antenna 201 can include an oblong loop attached to and substantially spanning about half of an internal surface of the riser spider 32 so that the antenna 201 follows the contour of the riser spider 32.

As illustrated in FIG. 5, embodiments of the present invention include, for example, a method 220 of tracking a plurality of riser pipe sections 29. The method 220 can include, for example, for each of a plurality of riser pipe sections 29, receiving riser pipe section identification data from a radio frequency identification tag 71 attached to an outside of and associated with a riser pipe section utilizing an antenna 201 during a feeding of the riser pipe section through a riser spider during assembly of a riser pipe string to separately identify each one of the plurality of riser pipe sections from each other of the plurality of riser pipe sections (221). The antenna 201 can include an oblong loop attached to and substantially spanning about half of an internal surface 205 of the riser spider so that the antenna 201 follows the contour of the riser spider. The method 220 can include, for example, determining a relative deployed position location of the each of the plurality of riser pipe sections 29 to form the riser pipe string (222).

FIGS. 1-9 illustrate an embodiment of a Riser Lifecycle Monitoring System (RLMS) which provides an integrated tool designed to improve the lifecycle performance of a marine riser through the application of remote diagnostics, online asset management, and readily accessible riser asset maintenance history, and to permit remote management of riser assets, with particular emphasis on riser joints. The riser lifecycle management system includes integrated hardware and software/program product components which can be combined in a central database preferably located on shore. This database can store asset information on every riser lifecycle management system equipped riser in the world. It also can permit transfer of a riser asset from one vessel to another while retaining all historic data. The vessel computers, in turn, can retrieve the data from sensors placed, for example, on each riser asset. The riser lifecycle management system beneficially provides for acquisition of riser load history data. Such acquisition can include gathering sensor data, multiplexing that data, and communicating it through the water column up to a vessel, while allowing for an acceptable level of fault tolerance. The data acquired depends on the type of sensor used on the riser asset. Such data provided by embodiments of the system can also allow for scheduled and unscheduled maintenance and for control of an associated riser tensioning system.

Figure 6:
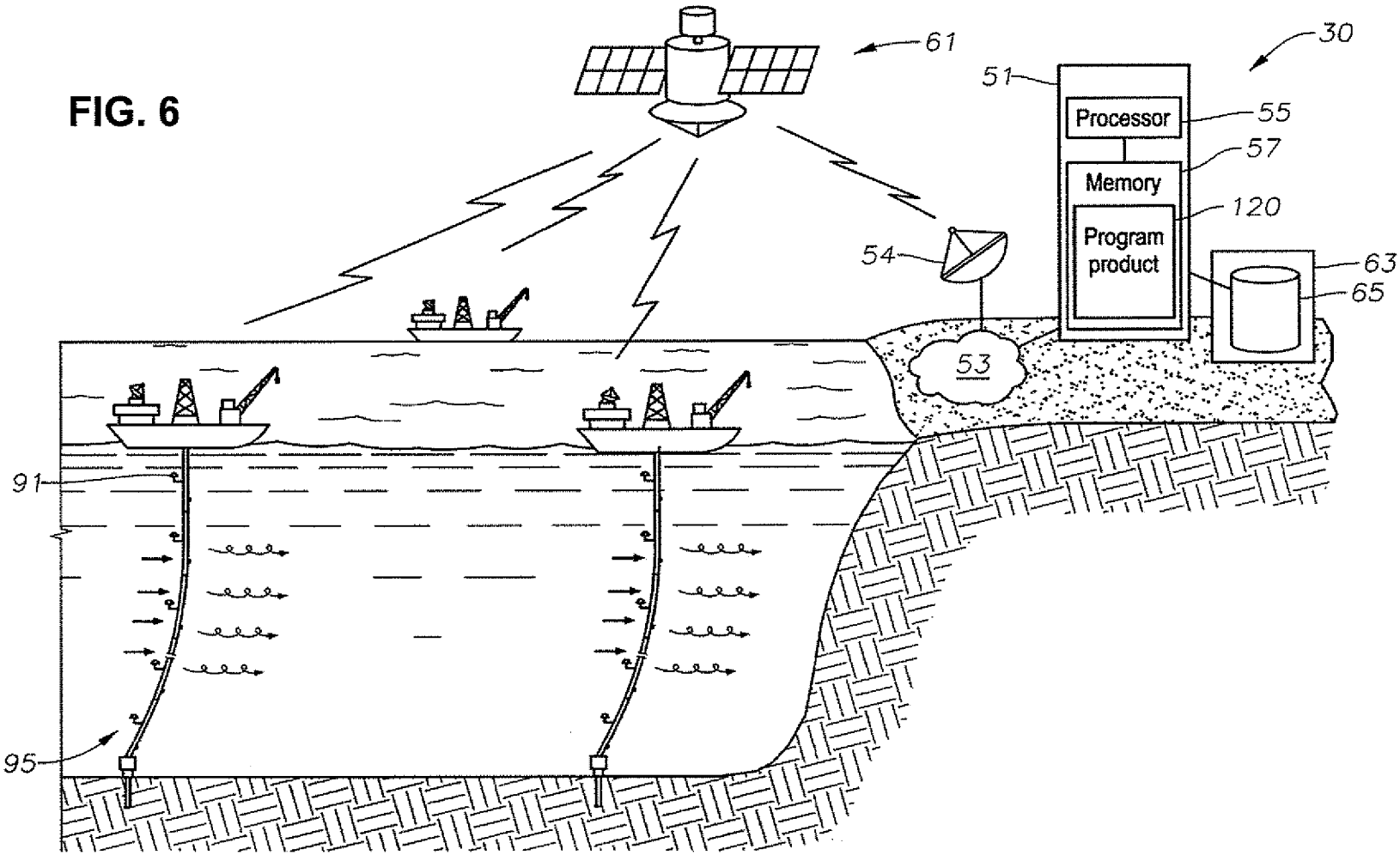
FIG. 6 is an environmental view of a system for monitoring and managing a plurality of marine riser assets according to an embodiment of the present invention.

As illustrated in FIGS. 6, 7A, 7B, and 8, the riser lifecycle management system 30 includes portions onshore and portions at each of the vessel locations. As illustrated in FIG. 6, the portion of the riser lifecycle management system 30 located at an onshore or other centralized location or locations can include at least one computer to remotely manage riser assets for a plurality of separate vessel locations defining a riser lifecycle management server 51 positioned in communication with an onshore local area communication network 53. The riser lifecycle management server 51 can include a processor 55 and memory 57 coupled to the processor 55. The memory 57 can include, for example, program product 120. The riser lifecycle management system 30 can also include a data warehouse 63 which can store relevant data on every piece of riser lifecycle management system equipped riser components anywhere in the world. The data warehouse 63 is assessable to the processor 55 of the riser lifecycle management server 51 and can be implemented in hardware, software, or a combination thereof. The data warehouse 63 can include at least one centralized database 65 configured to store asset information for a plurality of riser pipe sections 29, i.e., riser joints, and other riser assets of interest deployed at a plurality of separate vessel locations. The asset information can include, for example, the part number, serial number, relevant manufacturing records, operational procedures, and all maintenance records (including detailed information on the nature of the maintenance), just to name a few. This information is generally keyed into the riser lifecycle management system 30 at the time of manufacture or maintenance. The database 65 can also retain deployment and load history information, which can be acquired automatically from shipboard computers 41 located on each riser lifecycle management system equipped vessel 27. See also, e.g., FIG. 7A.

The riser lifecycle management system 30 can also include riser pipe section measurement instrument modules 91 and a subsurface communication medium 95, described herein.

The riser lifecycle management system 30 can also include, in communication with the onshore communication network 53, a receiver/transmitter 54 providing, for example, satellite-based communication to a plurality of vessels/drilling/production facilities each having a receiver/transmitter 44. The riser lifecycle management system 30 can also include, for example, a global communication network 61 providing a communication pathway between the shipboard computers 41 of each respective vessel 27 and the riser lifecycle management server 51 to permit transfer of riser asset information between the shipboard computers 41 and the riser life cycle management server 51.

Figure 7A:
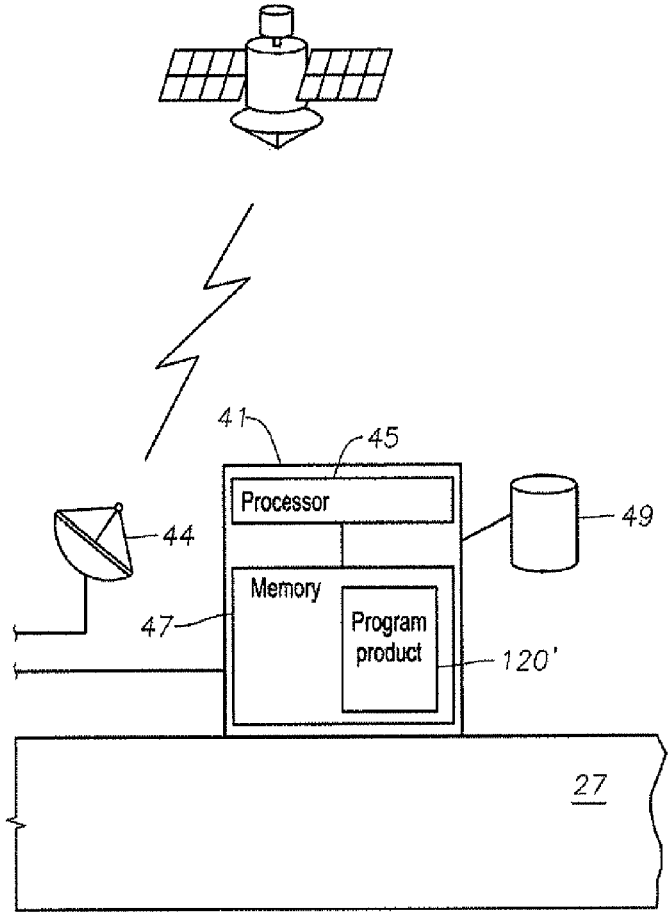
FIGS. 7A-7B are environmental views of a portion of the system for monitoring and managing a plurality of marine riser assets according to an embodiment of the present invention.
Figure 7B:
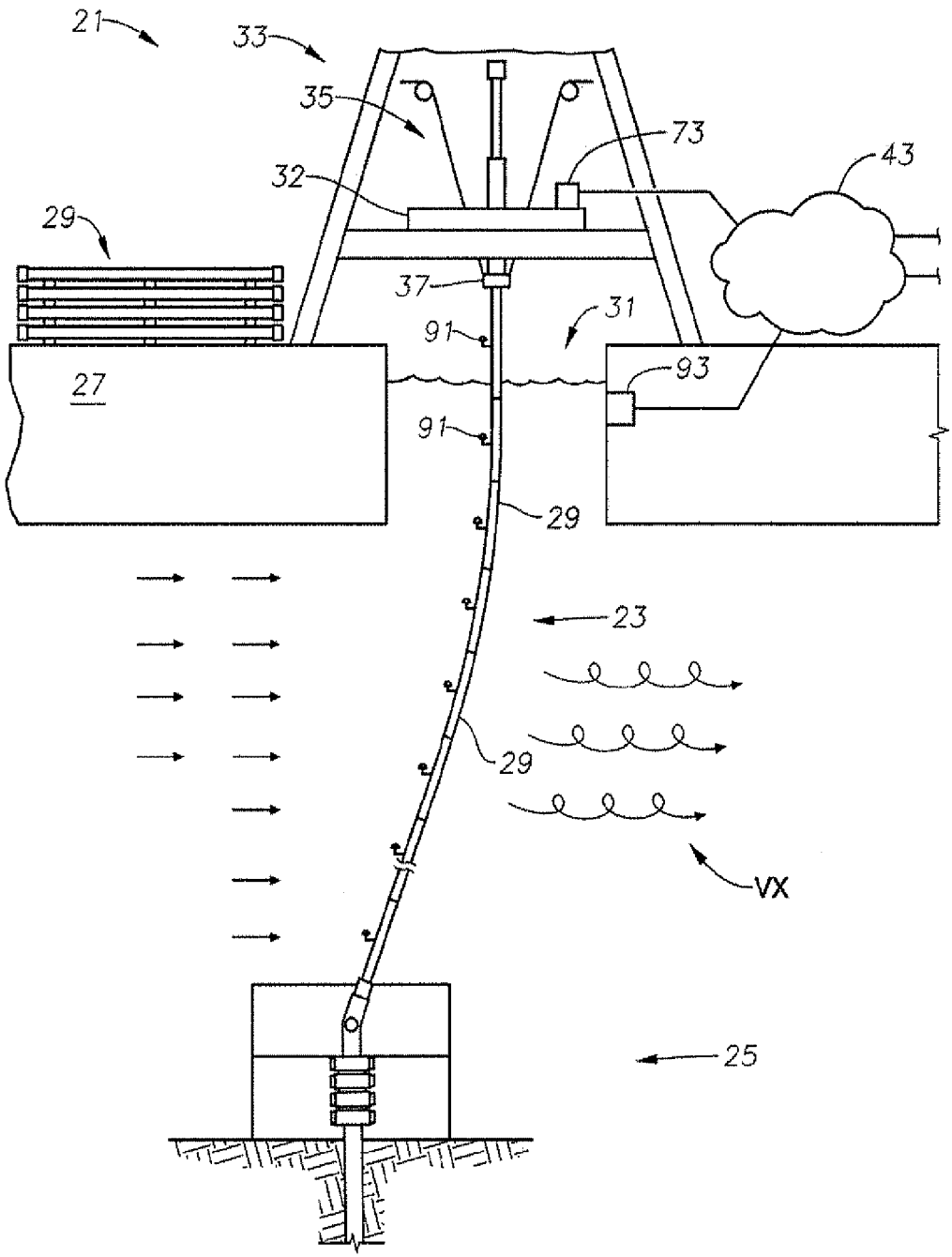
Figure 8:
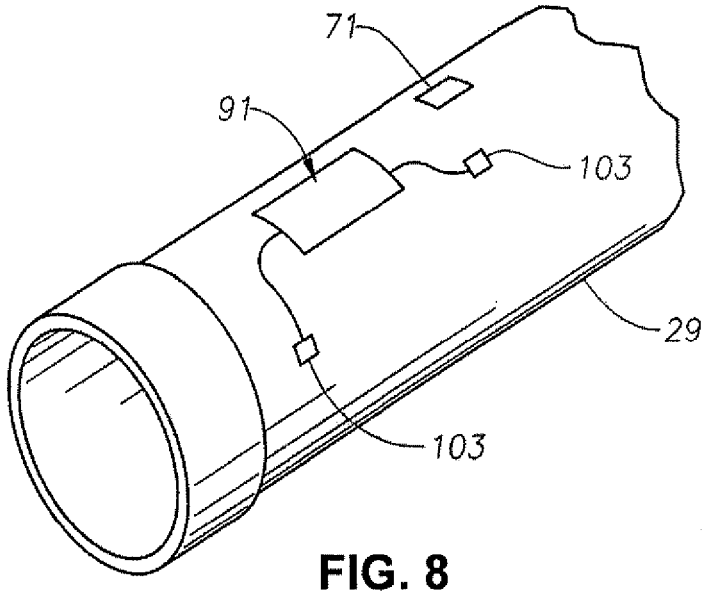
FIG. 8 is a perspective view of a riser joint carrying communication and identification hardware according to an embodiment of the present invention.

As illustrated in FIGS. 7A and 7B, the portion of the riser lifecycle management system 30 located at each at each of the vessel 27 locations can include, for example, a shipboard computer 41 in communication with a local shipboard communication network 43, e.g., LAN, or local area network. The shipboard computer 41 can include a processor 45, and memory 47 coupled to the processor 45. The memory 47 can include, for example, program product 120'. At least one database 49 accessible to the processor 45 of a shipboard computer 41 is also provided which can be used to store asset information for each of the plurality of riser joints deployed from the vessel 27. Such asset information can include riser joint identification data, riser joint deployment and location data, and riser joint load history data. Also in communication with the shipboard communication network 43 is a receiver/transmitter 44 providing, for example, satellite-based communication to onshore facilities.

As illustrated in FIG. 7B, the riser lifecycle management system 30 can include offshore drilling and/or production system 21, including a deployed riser pipe or conductor defining a riser string 23 extending between subsea wellhead system 25 and a floating vessel 27, such as, for example, a dynamically positionable vessel. The riser string 23 includes multiple riser sections or joints 29 connected together, for example, by a bolted flange or other means known to those skilled in the art. The vessel 27 includes a well bay 31 extending through a floor of the vessel 27, and typically includes a riser spider 32 positioned on an operational platform 33 in a well bay 31 to support the riser string 23 when riser joint connections are being made or broken during running or retrieval of the riser string 23. Embodiments of the present invention apply to both drilling and production risers. The vessel 27 also includes a tensioning system 35, located on the operational platform 33, which provides both lateral load resistance and vertical tension, preferably applied to a slip or tensioning ring 37 attached to the top of the riser string 23.

According to an embodiment of the present invention, the riser identification and deployment data for each riser joint 29 (or other riser asset of interest) is communicated, for example, to the shipboard computer 41 by means of a tag such as, for example, an RFID chip or tag 71 (see, e.g., FIG. 8) positioned on each riser joint 29, and an appropriate reader 73, for example, mounted on deck or otherwise connected to the vessel 27 at or adjacent the surface of the sea and operably coupled to or otherwise in communication with the shipboard computer 41 through the local shipboard communication network 43.

Further, the system 30 can also include riser joint measurement instrument modules 91 each positioned to sense a load represented by strain, riser pipe curve, or accelerometer data, etc. imposed on a separate one of the riser joints 29 forming the riser string 23, a riser joint load data receiver 93 mounted or otherwise connected to the vessel 27 at or adjacent the surface of the sea and operably coupled to the local shipboard communication network 43 to receive load data for each of the deployed riser joints 29 from the riser joint measurement instrument modules 91, and a subsurface communication medium 95 illustrated as provided via a series of replaceable wireless data telemetry stations providing a communication pathway between each of the joint measurement instrument modules 91 and the riser joint load data receiver 93 through a water column associated with the riser string 23.

The measurement instrument modules 91 can determine the magnitude of the loads imposed on the riser string 23 to calculate the magnitude of the stress at various locations on the riser joint 29 or other riser asset. Examples can include excessive stresses, deflections, accelerations, and high frequency alternating stresses in a cross flow motion due to, for example, vortex induced vibration caused by vortices VX. There are a number of methods under which the riser stresses can be measured. In one embodiment, the riser pipe strain is read at a sensor 103, since conversion of strain data to stresses is fairly straightforward and can be done via a relatively simple computer program element. Alternatively, the riser dynamics can be obtained via accelerometers, which may require a more complex set of operations for conversion to material stress from which the operational (e.g., fatigue) life can then be calculated. The load data sent to the riser lifecycle management server 51 can be in either raw data or converted to local stresses by the shipboard computer 41, or some intermediate form if some processing is accomplished by the instrument modules 91. According to an embodiment of the present invention, the sensor 103 is carried by a thin clamp-on composite mat (not shown), which can be used to accurately determine the deflection in the riser joint 29.

Embodiments of the riser lifecycle management system 30 can also include various methods relating to monitoring and managing a plurality of marine riser assets. For example, the shipboard computer 41 can compare ID data with the list of recently recorded tags. If a duplicate asset is reported, it is disregarded. That is, when utilizing automated reading sensors, the same riser asset may be scanned multiple times while being landed on the spider 32 or during the normal course of handling. As such, the preferred handling procedures can include disregarding duplicate records or duplicate reads within a preselected time period.

Embodiments of the apparatuses and associated methods according to the present invention provide several advantages and enhancements, in the context of a riser lifecycle management system 30. For example, embodiments provide for automatically reading identification tags on riser pipes, without requiring hand-held readers, manual processes, or interference with normal operations. That is, embodiments provide a low frequency (LF), stationary reader antenna built into a riser spider that allows riser pipes to be read automatically, as the pipes are fed through the riser spider.

In conjunction with a riser lifecycle management system 30, embodiments of the present invention can track marine riser pipe sections to thereby enable the system to notify automatically an operator of both routine and unscheduled maintenance events. A routine maintenance event is one that is scheduled sometime in advance, but may have been aided by load history information in the database. An unscheduled maintenance event is one associated with an unexpected incident. For example, one or more riser joints in a string that has been subjected to a direct hit by a hurricane may reach a preset fatigue life trigger level, requiring an inspection of the riser joint at the very least. In such a scenario, the operator would have a high degree of confidence that the remaining riser assets are suitable for marine deployment, reducing the down time associated with inspection of the entire riser string.

This application is related to co-owned U.S. Pat. No. 7,328,741 B2, titled "System for Sensing Riser Motion" issued on Feb. 12, 2008, and U.S. patent application Ser. No. 12/029,376, titled "Riser Lifecycle Management System, Program Product, and Related Method" filed Feb. 11, 2008, each of which is incorporated herein by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. An offshore drilling apparatus, comprising:

a plurality of riser pipe sections;

a plurality of radio frequency identification tags, each attached to an outside of one of the riser pipe sections;

a riser spider for supporting the plurality of riser pipe sections during assembly of a riser pipe string, the riser spider forming an annulus around a first section of the plurality of riser pipe sections and supporting the first section of the plurality of riser pipe sections during connection to a second section of the plurality of riser pipe sections;

an antenna comprising an oblong loop attached to and substantially spanning about half of an internal surface of the riser spider so that the antenna follows the contour of the riser spider; and a reader operably connected to the antenna for reading the plurality of radio frequency identification tags attached to the outsides of the plurality of riser pipe sections.

2. The apparatus of claim 1, wherein the riser spider comprises:

two portions that together close around the first section of the plurality of riser pipe sections to form the annulus, each portion comprising a semi-circumference of the annulus, where the antenna mounts wholly within one of the portions.

3. The apparatus of claim 2, wherein the two portions are connected by a hinge.

4. The apparatus of claim 1, further comprising:

an adhesive that attaches the antenna to the internal surface of the spider; and a protectant coating applied over the antenna to protect the antenna from an ocean environment.

5. The apparatus of claim 1, wherein the reader comprises:

a low-frequency, substantially stationary, passive device.

6. The apparatus of claim 1, wherein the radio frequency identification tags are directional.

7. The apparatus of claim 1, wherein the radio frequency identification tags are low-frequency 125 kHz tags.

8. The apparatus of claim 1, wherein the antenna substantially spans about 180 degrees of a ring defined by a cross-section of the riser spider.

9. The apparatus of claim 1, wherein the antenna comprises a semi-circle when viewed in a plane perpendicular to an axis of the riser spider.

10. The apparatus of claim 9, wherein at least a portion of the antenna extends in a direction parallel to the axis of the riser spider.

11. A method of tracking marine riser pipe sections, the method comprising:

providing a plurality of radio frequency identification tags attached to outsides of and associated with a plurality of riser pipe sections;

attaching an antenna to an internal surface of a riser spider, the antenna being in the configuration of an oblong loop substantially spanning up to about half of an internal surface of the riser spider so that the antenna follows the contour of the riser spider;

utilizing the riser spider to connect the plurality of riser pipe sections during assembly of a riser pipe string, the riser spider forming an annulus around a first section of the plurality of riser pipe sections to support the first section of the plurality of riser pipe sections during connection to a second section of the plurality of riser pipe sections; and reading each of the plurality of radio frequency identification tags during a feeding of the associated riser pipe section through the riser spider by utilizing the antenna.

12. The method of claim 11, wherein the riser spider comprises:

two portions that together close around the first section of the plurality of riser pipe sections to form the annulus, each portion comprising a semi-circumference of the annulus, wherein the antenna mounts wholly within one of the portions.

13. The method of claim 11, wherein the two portions are connected by a hinge.

14. The method of claim 11, further comprising attaching the antenna to the internal surface of the riser spider with an adhesive; and applying a protective coating over the antenna after it is attached.

15. The method of claim 11, wherein the step of reading each of the plurality of radio frequency identification tags further includes operably connecting a low-frequency, substantially stationary, passive reader of radio frequency identification tags to the antenna, and placing the reader apart from the spider.

16. A method of tracking a plurality of riser pipe sections, the method comprising the steps of:

(a) attaching a radio frequency identification tag to an outside of each of the riser pipe sections;

(b) attaching an antenna to an internal surface of a riser spider the antenna comprising an oblong loop attached to and substantially spanning about half of an internal surface of the riser spider so that the antenna follows the contour of the riser spider;

(c) connecting a radio frequency identification tag reader to the antenna and placing the reader apart from the riser spider;

(d) lowering a first section of the riser pipe sections into the riser spider and supporting the first section with the riser spider and connecting a second section of the riser pipe sections to the first section of the riser pipe sections, and repeating the step (c) to make up a riser pipe string;

(e) with the antenna and the reader, reading each of the radio frequency identification tags as the riser pipe sections pass through the riser spider during step (c); and (f) transmitting the information read in step (e) to a computer, and with the computer, determining a relative deployed position location of the each of the plurality of riser pipe sections that form the riser pipe string.

17. The method of claim 16, wherein the riser spider comprises:

two portions that together close around the first section of the plurality of riser pipe sections to form the annulus, each portion comprising a semi-circumference of the annulus, wherein the antenna mounts wholly within one of the portions.

18. The method of claim 17, wherein the two portions are connected by a hinge.

19. The method of claim 16, wherein step (b) comprises attaching the antenna to the internal surface of the riser spider with an adhesive, then applying a protectant coating over the antenna.

20. The method of claim 16, wherein the radio frequency identification tags are directional, and wherein the radio frequency identification tags are low-frequency 125 kHz.

* * * * *

UNITED STATES PATENT AND TRADEMARK OFFICE

CERTIFICATE OF CORRECTION

PATENT NO. : 8,464,946 B2
APPLICATION NO. : 12/710707
DATED : June 18, 2013
INVENTOR(S) : Mackenzie et al.

It is certified that error appears in the above-identified patent and that said Letters Patent is hereby corrected as shown below:

In the Claims:

In Column 9, Line 2, in Claim 1, delete "spanning about" and insert -- spanning up to about --, therefor.

In Column 10, Line 8, in Claim 13, delete "claim 11," and insert -- claim 12, --, therefor.

In Column 10, Line 12, in Claim 14, delete "adhesive;" and insert -- adhesive, --, therefor.

In Column 10, Line 24, in Claim 16, delete "spider" and insert -- spider, --, therefor.

In Column 10, Line 34, in Claim 16, delete "the" and insert -- this --, therefor.

In Column 10, Line 45, in Claim 17, delete "the" and insert -- an --, therefor.

Signed and Sealed this
Third Day of September, 2013

Teresa Stanek Rea
*Acting Director of the United States Patent and Trademark Office*